US005976002A

United States Patent [19]

Keough

[11] Patent Number: 5,976,002

[45] Date of Patent: Nov. 2, 1999

[54] KNIFE SHARPENER

[76] Inventor: Gilbert Keough, Box 483, 5 S. Allentown Rd., Tylersport, Pa. 18971

[21] Appl. No.: 09/007,316

[22] Filed: Jan. 15, 1998

[51] Int. Cl.[6] ..... B24B 33/00

[52] U.S. Cl. ..... 451/556; 451/486; 451/552

[58] Field of Search ..... 451/556, 540, 451/552, 45, 486, 555

[56] References Cited

U.S. PATENT DOCUMENTS

| | | | |
|---|---|---|---|
| 651,644 | 6/1900 | Abbott | 15/218.1 |
| 1,851,520 | 3/1932 | Moller | 451/486 |
| 2,431,188 | 11/1947 | Miller | 51/214 |
| 2,507,826 | 5/1950 | Spencer | 51/214 |
| 2,826,879 | 3/1958 | Evans | 51/214 |
| 4,025,319 | 5/1977 | Smith | 51/208 |
| 4,229,910 | 10/1980 | McRae | 51/211 H |
| 4,272,925 | 6/1981 | Graves | 51/211 R |
| 4,799,335 | 1/1989 | Battocchi | 51/102 |
| 4,866,845 | 9/1989 | McEvily | 30/138 |
| 4,912,885 | 4/1990 | Bonapace | 51/211 H |

*Primary Examiner*—David A. Scherbel
*Assistant Examiner*—Dung Van Nguyen

[57] ABSTRACT

A knife sharpener is provided including a base. A plurality of sharpening members are positioned on the base and situated in side-by-side relationship. Also included is a biasing assembly for urging the sharpening members into abutment.

12 Claims, 3 Drawing Sheets

KNIFE SHARPENER

BACKGROUND OF THE INVENTION

1. Field of the Invention

The present invention relates to knife sharpeners and more particularly pertains to a new knife sharpener for sharpening a blade with a plurality of spring biased rods which are rotatable.

2. Description of the Prior Art

The use of knife sharpeners is known in the prior art. More specifically, knife sharpeners heretofore devised and utilized are known to consist basically of familiar, expected and obvious structural configurations, notwithstanding the myriad of designs encompassed by the crowded prior art which have been developed for the fulfillment of countless objectives and requirements.

Known prior art knife sharpeners include U.S. Pat. No. 4,799,335; U.S. Pat. No. 4,229,910; U.S. Pat. No. 4,025,319; U.S. Pat. No. 4,912,885; U.S. Pat. No. 4,866,845; and U.S. Patent Des. 327,402.

In these respects, the knife sharpener according to the present invention substantially departs from the conventional concepts and designs of the prior art, and in so doing provides an apparatus primarily developed for the purpose of sharpening a blade with a plurality of spring biased rods which are rotatable.

SUMMARY OF THE INVENTION

In view of the foregoing disadvantages inherent in the known types of knife sharpeners now present in the prior art, the present invention provides a new knife sharpener construction wherein the same can be utilized for sharpening a blade with a plurality of spring biased rods which are rotatable.

The general purpose of the present invention, which will be described subsequently in greater detail, is to provide a new knife sharpener apparatus and method which has many of the advantages of the knife sharpeners mentioned heretofore and many novel features that result in a new knife sharpener which is not anticipated, rendered obvious, suggested, or even implied by any of the prior art knife sharpeners, either alone or in any combination thereof.

To attain this, the present invention generally comprises a base having a planar square bottom face and a periphery coupled thereto and extending upwardly therefrom to define an open top. The periphery includes a pair of opposed side faces and a pair of opposed end faces. The end faces includes a first end face having a plurality of horizontally aligned oval apertures formed therein, as shown in FIG. 4, A second end face is equipped with a rectangular cut out. For preventing damage to a surface on which the base is situated, the bottom face ideally has a pad situated on each of its corners. Next provided is a plurality of cylindrical rods each including a pair of ends and a periphery having a roughened sharpening surface. The ends include a first end with a slot formed therein. During use, the first end of each cylindrical rod is rotatably and slidably positioned in a corresponding one of the oval apertures of the base. As shown in FIG. 3, the cylindrical rods are situated in side-by-side relationship. In such configuration, a second end of each rod slightly protrudes from the rectangular cut out. As best shown in FIGS. 3 & 4, a biasing assembly is provided including a pair of L-shaped members each having vertical extent abutting an end one of the rods adjacent to the first end face of the base. Associated therewith is a horizontal extent situated on top of the rods. The biasing assembly includes two pairs of springs each situated between the associated side face of the base and the vertical extent of the corresponding L-shaped member. The two pairs of springs are adapted for urging the rods together by way of an expansion force. The biasing assembly further includes another pair of springs connected between the horizontal extents of the L-shaped member. The instant springs provide a contraction force for further urging the rods together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knife sharpener apparatus and method which has many of the advantages of the knife sharpeners mentioned heretofore and many novel features that result in a new knife sharpener which is not anticipated, rendered obvious, suggested, or even implied by any of the prior art knife sharpeners, either alone or in any combination thereof.

It is another object of the present invention to provide a new knife sharpener which may be easily and efficiently manufactured and marketed.

It is a further object of the present invention to provide a new knife sharpener which is of a durable and reliable construction.

An even further object of the present invention is to provide a new knife sharpener which is susceptible of a low cost of manufacture with regard to both materials and labor, and which accordingly is then susceptible of low prices of sale to the consuming public, thereby making such knife sharpener economically available to the buying public.

Still yet another object of the present invention is to provide a new knife sharpener which provides in the apparatuses and methods of the prior art some of the advantages thereof, while simultaneously overcoming some of the disadvantages normally associated therewith.

Still another object of the present invention is to provide a new knife sharpener for sharpening a blade with a plurality of spring biased rods which are rotatable.

Even still another object of the present invention is to provide a new knife sharpener that includes a base. A plurality of sharpening members are positioned on the base and situated in side-by-side relationship. Also included is a biasing assembly for urging the sharpening members into abutment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
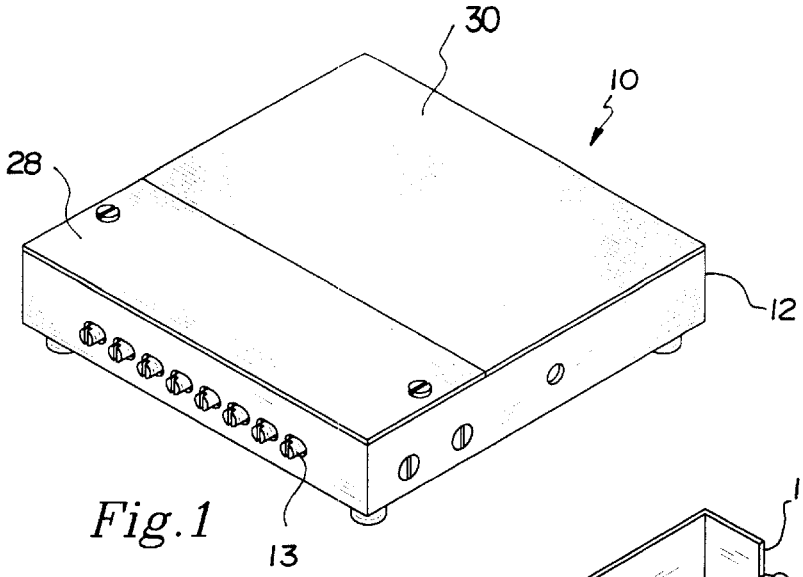
FIG. 1 is a perspective view of a new knife sharpener according to the present invention.
Figure 2:
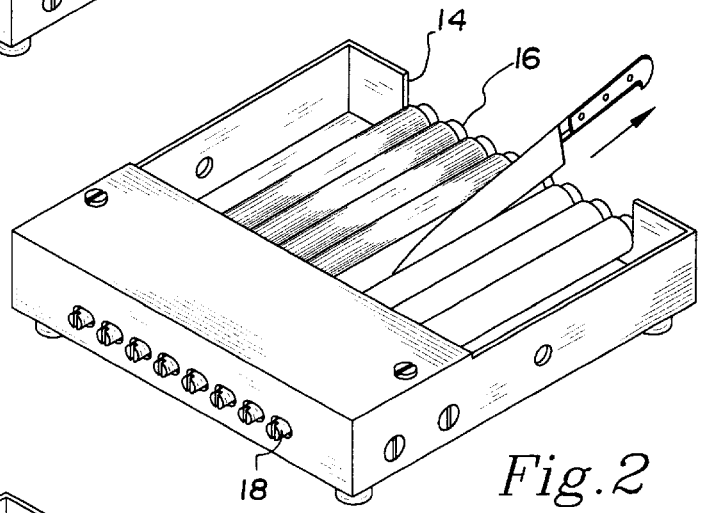
FIG. 2 is a perspective view of the present invention with access made readily available to the sharpening rods.

With reference now to the drawings, and in particular to FIGS. 1 through 7 thereof, a new knife sharpener embodying the principles and concepts of the present invention and generally designated by the reference numeral 10 will be described.

Figure 4:
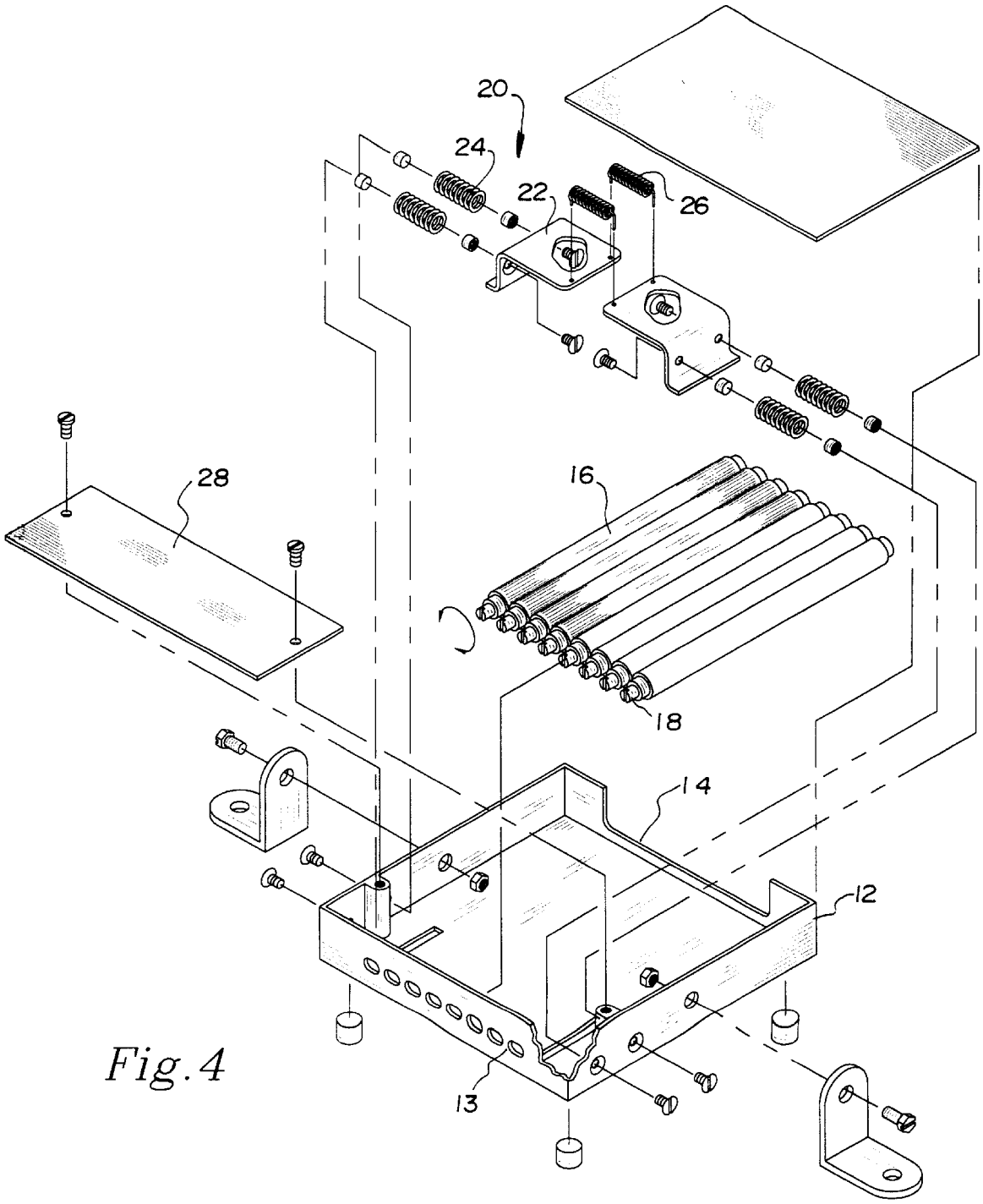
FIG. 4 is an exploded view of the present invention.

The present invention, designated as numeral 10, includes a base 12 having a planar square bottom face and a periphery coupled thereto and extending upwardly therefrom to define an open top. The periphery includes a pair of opposed side faces and a pair of opposed end faces. The end faces includes a first end face having a plurality of horizontally aligned oval apertures 13 formed therein, as shown in FIG. 4, A second end face is equipped with a rectangular cut out 14. For reasons that will become apparent hereinafter, the ends of the cut out are preferably arcuate. For preventing damage to a surface on which the base is situated, the bottom face ideally has a pad situated on each of its corners.

Next provided is eight cylindrical rods 16 each including a pair of ends and a periphery having a roughened sharpening surface. It is preferred that the cylindrical rods are each equipped with peripheries of various grains of stone or steel. Each of the ends preferably has a reduced diameter. The ends include a first end with a slot 18 formed therein. For reasons that will soon become apparent, the slot functions to allow the rotation of the rods via a screwdriver.

Figure 3:
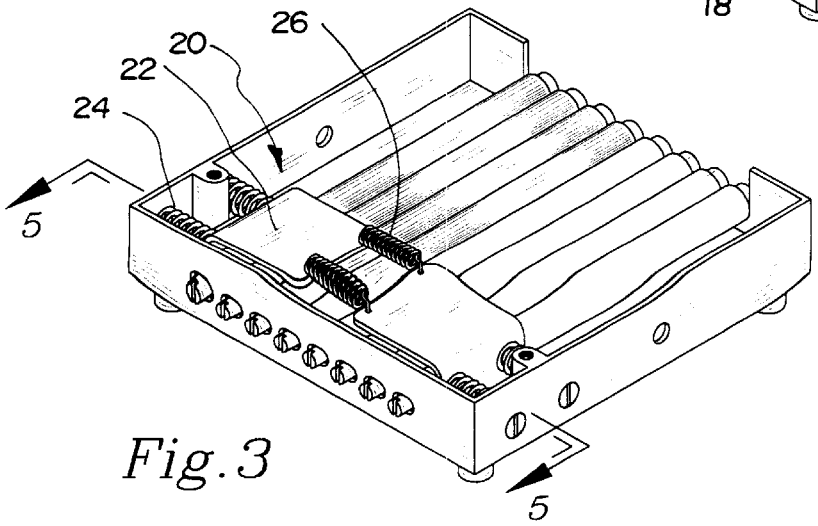
FIG. 3 is a perspective view of the present invention showing the biasing assembly.

During use, the first end of each cylindrical rod is rotatably and slidably positioned in a corresponding one of the oval apertures of the base. As shown in FIG. 3, the cylindrical rods are situated in side-by-side relationship. In such configuration, a second end of each rod slightly protrudes from the rectangular cut out.

Figure 5:
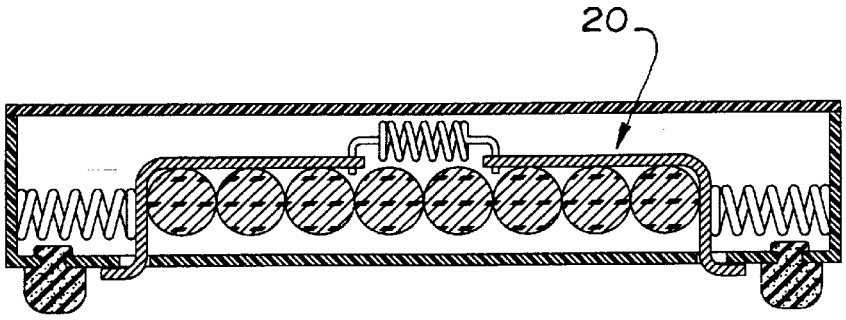
FIG. 5 is an end cross-sectional view of the present invention.
Figure 6:
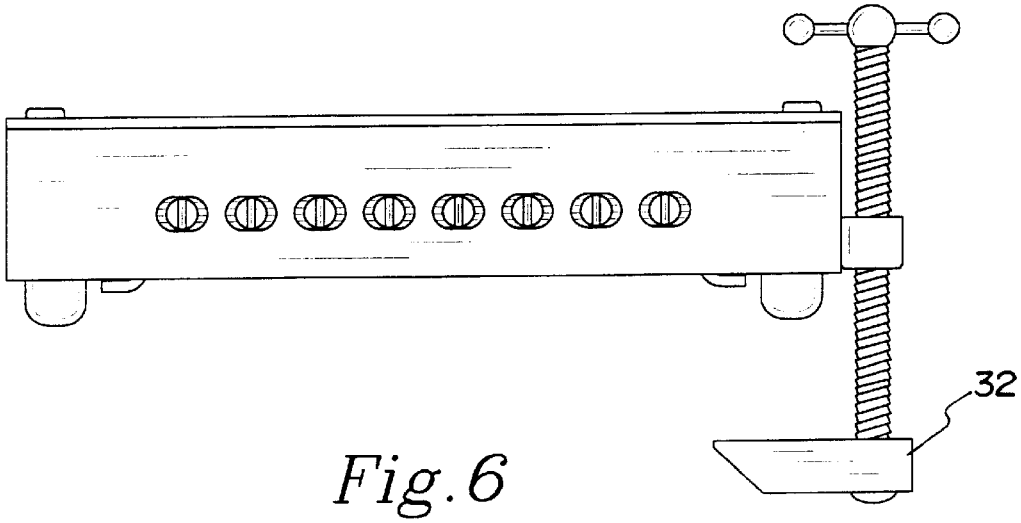
FIG. 6 is an end view of an alternate embodiment of the present invention.
Figure 7:
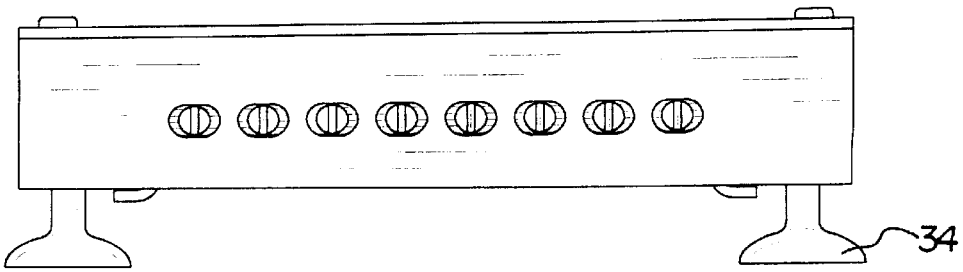
FIG. 7 is an end view of yet another embodiment of the present invention.

As best shown in FIGS. 3 & 4, a biasing assembly 20 is provided including a pair of L-shaped members 22 each having vertical extent abutting an end one of the rods adjacent to the first end face of the base. Associated therewith is a horizontal extent situated on top of the rods. In the preferred embodiment, a width of each L-shaped member is less than ¼ that of the rods. Further, as shown in FIG. 5, a lower edge of each L-shaped member includes a lip extending through an associated slot formed in the bottom face of the base.

The biasing assembly further includes two pairs of springs 24 each situated between the associated side face of the base and the vertical extent of the corresponding L-shaped member. The two pairs of springs are adapted for urging the rods together by way of an expansion force. To maintain the springs in place, the vertical extents of the L-shaped member and the side faces of the base each have small disk-shaped tabs coupled thereto for receiving an associated end of the spring.

The biasing assembly further includes another pair of springs 26 connected between the horizontal extents of the L-shaped member. The instant springs provide a contraction force for further urging the rods together. For coupling the present springs to the L-shaped members, the springs have ends which define hooks while the L-shaped members each have apertures formed therein. During use, the biasing assembly accommodates blades of varying widths.

Finally, a cover 28 having a planar rectangular configuration is provided. The cover serves for being removably coupled over the biasing assembly in coplanar relationship with the open top of the base. It should be noted that the cover has a width equal to about ⅓ that of the base. The cover is preferably coupled via multiple screws. Shown in FIGS. 1 & 4 is another cover 30 which is more readily removed for access to the rods for sharpening purposes. As an option, mere clips or the like may used to maintain the additional cover in place.

In various alternate embodiments, a C-clamp 32 may be mounted to one of the side faces of the base. Note FIG. 6. Such C-clamp is adapted to clamp a lower surface of a lip associated with a recipient surface on which the base is positioned. In yet another alternate embodiment, shown in FIG. 7, the pads are replaced with suction cups 34. It should be noted that various other types of brackets may also be employed for purposes similar to those of the C-clamp and suction cups.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knife sharpener comprising, in combination:

a base having a planar square bottom face and a periphery coupled thereto and extending upwardly therefrom to define an open top, the periphery including a pair of opposed side faces and a pair of opposed end faces, the end faces including a first end face having a plurality of horizontally aligned oval apertures formed therein and a second end face with a rectangular cut out, the bottom face having a pad situated on each corner thereof;

a plurality of cylindrical rods each including a pair of ends and a periphery having a roughened sharpening surface, the ends including a first end with a slot formed therein wherein the first end of each cylindrical rod is rotatably and slidably positioned in a corresponding one of the oval apertures of the base, the cylindrical rods being situated in side-by-side relationship with a second end of each rod protruding from the rectangular cut out;

a biasing assembly including a pair of L-shaped members each having vertical extent abutting an end one of the rods adjacent to the first end face of the base and a horizontal extent situated on top of the rods, the biasing assembly including two pairs of springs each situated between the associated side face of the base and the vertical extent of the corresponding L-shaped member for urging the rods together, the biasing assembly further including another pair of springs connected between the horizontal extents of the L-shaped member for further urging the rods together; and a cover having a planar rectangular configuration for being removably coupled over the biasing assembly in coplanar relationship with the open top of the base, wherein the cover has a width equal to about ⅓ that of the base.

2. A knife sharpener comprising:

a base;

a plurality of sharpening members positioned on the base and situated in side-by-side relationship; and a biasing assembly for urging the sharpening members into abutment;

wherein each sharpening member comprises a cylindrical rod;

wherein each cylindrical rod has means for allowing the manual rotation thereof, wherein the means includes a slot.

3. A knife sharpener as set forth in claim 2 wherein the biasing assembly includes a pair of L-shaped members.

4. A knife sharpener as set forth in claim 2 wherein the biasing assembly includes at least one coil spring.

5. A knife sharpener as set forth in claim 2 wherein the base includes an interior space and an open top through which the sharpening members are accessed.

6. A knife sharpener as set forth in claim 2 wherein at least one suction cup is mounted on a lower surface of the base.

7. A knife sharpener as set forth in claim 2 wherein a C-clamp is mounted on the base.

8. A knife sharpener comprising:

a base;

a plurality of sharpening members positioned on the base and situated in side-by-side relationship; and a biasing assembly for urging the sharpening members into abutment;

wherein the biasing assembly includes a pair of L-shaped members;

wherein each sharpening member comprises a cylindrical rod, each cylindrical rod having a slot for allowing the manual rotation thereof.

9. A knife sharpener as set forth in claim 8 wherein the biasing assembly includes at least one coil spring.

10. A knife sharpener as set forth in claim 8 wherein the base includes an interior space and an open top through which the sharpening members are accessed.

11. A knife sharpener as set forth in claim 8 wherein at least one suction cup is mounted on a lower surface of the base.

12. A knife sharpener as set forth in claim 8 wherein a C-clamp is mounted on the base.

* * * * *